US005676890A

United States Patent [19]

Ott

[11] Patent Number: 5,676,890

[45] Date of Patent: Oct. 14, 1997

[54] AERATION DEVICE

[75] Inventor: Wilfried Ott, Langenhagen, Germany

[73] Assignee: Rita Ott, Langenhagen, Germany

[21] Appl. No.: 663,210

[22] PCT Filed: Dec. 10, 1994

[86] PCT No.: PCT/DE94/01466

§ 371 Date: Jun. 11, 1996

§ 102(e) Date: Jun. 11, 1996

[87] PCT Pub. No.: WO95/16514

PCT Pub. Date: Jun. 22, 1995

[30] Foreign Application Priority Data

Dec. 13, 1993 [DE] Germany ..... 43 42 376.0
Oct. 5, 1994 [DE] Germany ..... 44 35 600.5

[51] Int. Cl.[6] ..... B01F 3/04
[52] U.S. Cl. ..... 261/122.2
[58] Field of Search ..... 261/122.2

[56] References Cited

U.S. PATENT DOCUMENTS

| | | | |
|---|---|---|---|
| 4,818,446 | 4/1989 | Schreiber et al. | 261/122.2 |
| 4,954,296 | 9/1990 | Ott | 261/122.2 |
| 5,304,301 | 4/1994 | Schimdt | 261/122.2 |

FOREIGN PATENT DOCUMENTS

| | | | |
|---|---|---|---|
| 0 482 332 | 4/1992 | European Pat. Off. . | |
| 0 345 207 | 8/1993 | European Pat. Off. . | |
| 33 17917 | 11/1984 | Germany . | |
| 34 18548 | 11/1985 | Germany . | |
| 3514028 | 10/1986 | Germany | 261/122.2 |
| 36 24580 | 2/1988 | Germany . | |
| 36 36882 | 5/1988 | Germany . | |
| 40 33384 | 4/1992 | Germany . | |

*Primary Examiner*—Tim R. Miles
*Attorney, Agent, or Firm*—Burns, Doane, Swecker & Mathis, L.L.P.

[57] ABSTRACT

Described is a gas-introduction device designed to introduce a gas into a liquid. The device comprises at least one gas-feed manifold (10) and a multiplicity of tubular feed-in elements (12) which are open at the free end. Each feed-in element is surrounded by a perforated tubular membrane (14). A gas-supply line in each feed-in element terminates in the vicinity of the membrane. Each feed-in element comprises two support elements (46, 48) extending out from a central element. The central element has a flange which is designed to be fastened to the outside of the gas-feed manifold. A gas-supply line leads from a bore in the gas-feed manifold, via a central line (26) and two branch lines (28) leading off the central line (26), into longitudinal grooves behind the membrane. The central line and the branch lines are located in the central element. The feed-in element is a monobloc construction including the central element and the membrane-support elements.

22 Claims, 3 Drawing Sheets

AERATION DEVICE

The invention relates to an aeration device as claimed in the preamble of Claim 1.

Aeration devices of this type are preferably used to introduce air into waste water when it is treated to permit aerobic decomposition processes in the waste present in the water. Since the gas is always lighter than the waste water, the former must be introduced from the bottom of the container or basin, covering as wide an area as possible so that the bubbles do not merely pass through the liquid and exit at the surface. In this case, achieving the required saturation of the water would not be possible.

An aeration device which is known from EP 0 345 207 B1 comprises one or more gas distributors from the sides of which a number of inlet bodies lead. This ensures that the gas is distributed over a wide area. With the known aeration devices, such bodies are screwed to the gas distributor with connection pieces. Therefore, separate inlet bodies are needed for each side. Assembly is time-consuming due to the number of bodies which must be screwed on.

Especially in the case of long inlet bodies, movement of the waste water caused by agitators creates strains which can easily lead to mechanical damage.

Furthermore, an aeration device with which integral inlet bodies are attached to a gas distributor by means of supports extending from a central body is known from DE 36 36 882 C1. The method of attachment makes use of clamping elements which grip both the central body and receiving grooves located on the sides of the gas distributor. Each support is covered by a perforated, hose-shaped membrane fastened to the support by means of hose clamps at both ends of the membrane. The inner hose clamps simultaneously fasten the central body to the receiving grooves of the gas distributor. The liquid can flow between the central body and the gas distributor via a bored hole, and the former is enclosed by cupped inserts located approximately in the middle of the support. Outlets through which the gas can pass lead from the space between the cupped inserts to the areas where the membranes are located.

Obtaining a flow of gas into the liquid which is as even as possible, and over the outer surfaces of the membrane on the supports also, requires that the interior of the inlet bodies extend as far outward as possible. However, this produces an undesirable increase in buoyancy as a result of the larger volume of gas present in the said bodies.

The object of the invention is to create an aeration device of the type claimed in the preamble of Claim 1 which permits an even flow of gas into the liquid over the length of the membrane, at the same time with inlet bodies which are not highly buoyant, and which permits easy assembly of the aeration device and attachment of the inlet bodies to the gas distributor in a way which is subject to less strain and therefore safer.

This object is fulfilled with an aeration device as claimed in the preamble of Claim 1 with the features given in the characterizing part.

The embodiment according to the invention ensures an even flow of gas over the length of the membrane by means of the gas outlets, comprising gas feed channels in the form of longitudinal grooves. An arrangement with a central channel and two secondary channels leading from it limits the volume of gas in the inlet body, thereby reducing the amount of buoyancy. With the attachment of the inlet bodies to the gas distributor, both gas feed channels of each body are automatically fed through the gas distributor's connection to the central channel via the bored hole.

In a preferred embodiment, the wall thickness of the supports decreases from the central body to their free ends. As the bending moment load of the supports resulting from the liquid's movement caused by agitators decreases as the distance to the gas distributor increases, a reduction in the amount of material is possible without risking damage to the support.

The supports are preferably provided with outlets near the central body which are located in their upper section when ready for operation. These outlets permit liquid to flow through and exit the interior of the supports from the free open ends. Deposits of anaerobic sludge in the interior and the resulting formation of toxic substances, which is otherwise possible, is thereby prevented.

A practical method of attaching the inlet body to the gas distributor makes use of a screw which penetrates the central channel axially and which is provided with a locknut which braces the wall of the gas distributor near the flange on the central body. The locknut possesses the shape of a small bridge which is narrower and longer than the bored hole in the gas distributor. This attachment method permits easy and quick mounting of the inlet body to the gas distributor, as the locknut is fixed automatically.

In a practical embodiment, the locknut is provided with a centering collar which penetrates the bored hole of the gas distributor. This centering collar can be conically shaped. When the inlet body is mounted by means of the screw, the centering collar ensures that the central channel in the central body is precisely aligned with the bored hole in the gas distributor, creating a connection for the flow of liquid between the two parts.

A bond which is especially resistant to twisting can be achieved when the locknut is provided with claws which penetrate the material of the gas distributor when tightened.

Furthermore, a sealing disk, preferably in the shape of an O-ring and located between the head of the screw and the surface of the inlet body, can be placed between the gas distributor and the flange of the central body. These seals prevent an undesirable escape of gas near the screw head and the flange.

The flange located on the central body can be provided with lateral centering shoulders. These centering shoulders facilitate proper positioning of the central body during mounting.

A further possibility for positive centering of the inlet body on the gas distributor makes use of a projection with two axial slits on the said body. This projection can simultaneously prevent undesirable twisting of the locknut by receiving the latter in its slits.

The projection is preferably beveled. This shape facilitates mounting of the inlet body on the gas distributor at an angle for the purpose of inserting the locknut on the screw into the gas distributor's bored hole.

Further examples and preferred embodiments of the invention follow from the claims, the further description and the drawings, which show examples of such embodiments.

Figure 1:
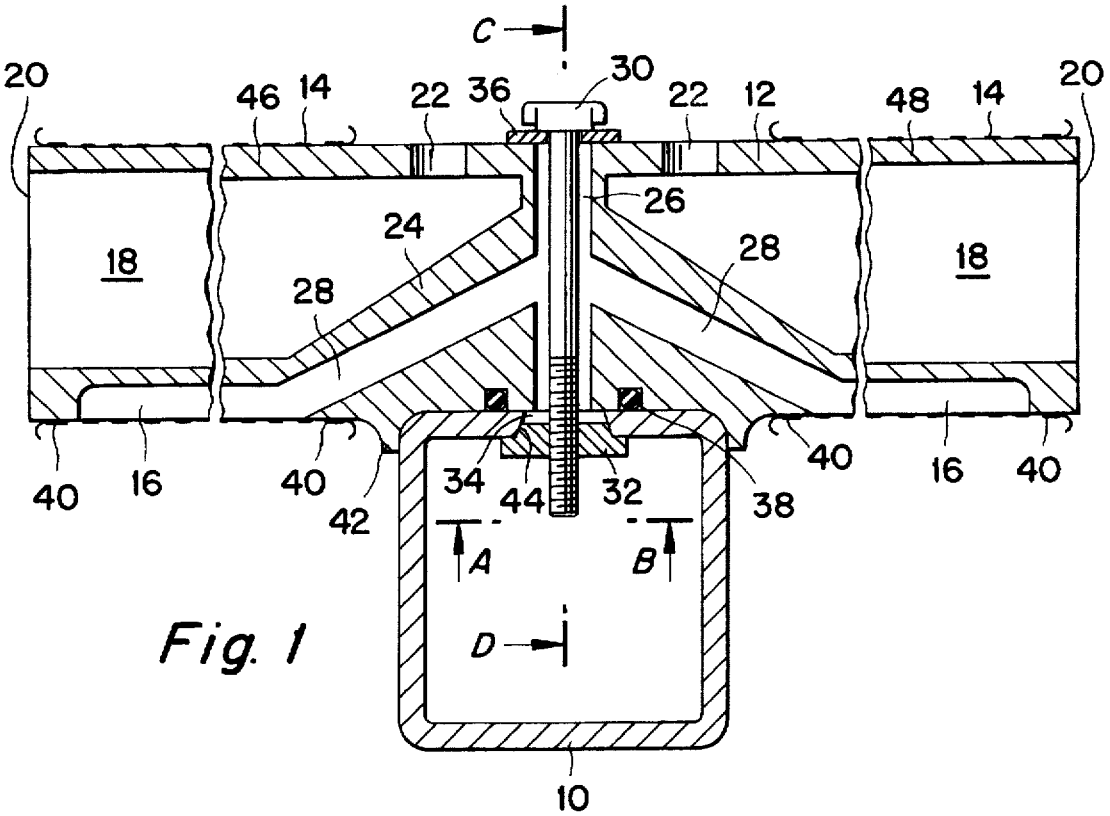
FIG. 1 a longitudinal section of an inlet body attached to a gas distributor.
Figure 2:
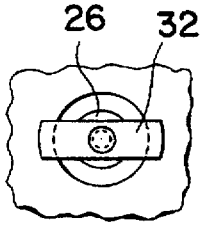
FIG. 2 a view AB of a locknut in a detail from FIG. 1.

The aeration device shown in FIG. 1 comprises a gas distributor 10 to which an inlet body 12 is attached. The inlet body 12 comprises a central body 24 with two lateral supports 46 and 48. The inlet body 12 is braced against the gas distributor 10 by means of a flange located near the central body 24 which is provided with lateral centering shoulders 42. This bond is created by means of a screw 30 and a locknut 32 which covers a bored hole 34 in the gas distributor 10.

The gas is fed from the hollow gas distributor 10 through a bored hole 34 in the gas distributor 10, along a central channel 26 in the central body 24 to secondary channels 28, which are also located in the central body 24. The secondary channels 28 terminate in gas feed channels 16 in the form of longitudinal grooves in the supports 46 and 48. The supports 46 and 48 are encompassed by perforated membranes 14 which completely cover the gas feed channels 16 and which are attached axially next to the gas feed channels 16 by means of clamps 40.

In order to permit the overflow of gas from the interior of the gas distributor 10 into the central channel 26 of the inlet body 12, the locknut 32 possesses the shape of a flat bridge which is narrower and longer than the diameter of the central channel 26 and the bored hole 34. The locknut 32 thereby makes an attachment possible by means of tabs which project in a longitudinal direction; however, gaps remain at the side of the narrow bridge through which the gas can enter the central channel. An undesirable escape of gas from the area near the screw 30 or entrance of waste water into the gas feed channels can be prevented by placing a seal in the shape of an O-ring 38 near the flange on the central body 24 and sealing the head of the screw 30 against the surface of the inlet body 12 by means of a sealing disk 36.

While the centering shoulders 42 serve to align the gas distributor 10 with the flange on the central body 24, a centering collar 44 on the locknut 32 aligns the locknut 32 with the bored hole 34 in the gas distributor 10. The centering collar 44 can be conically shaped so that it simultaneously prevents twisting when the locknut 32 enters the bored hole 34 axially and wedges there. Alternatively or in addition, the projecting tabs on the locknut can also possess the shape of claws which penetrate the surface of the gas distributor 10.

Buoyancy of the aeration device can be prevented when the interior 18 of the supports 46 and 48 of the inlet body 12 communicates with the waste water at the free ends. As a result, the waste water can enter this area.

It has been demonstrated with the known aeration devices that the waste water standing in the interior 18 is not supplied with a sufficient amount of oxygen in comparison to waste water which is agitated. As a result, anaerobic sludge can be formed in this area. This anaerobic sludge contains toxic substances which prevent the propagation of desirable bacteria necessary for decomposition of the pollutants in the waste water. Even though the waste water in the interior 18 is primarily considered to be stationary, certain amounts of the toxic substances present in the anaerobic sludge are always passed to the surrounding space, thereby negatively influencing the effectiveness of the waste water treatment system.

The inlet body 12 is provided with outlets 22 located in the upper section when ready for operation for the purpose of preventing this phenomenon. Waste water can flow through these outlets and the interior 18 from the free ends, and then exit through the outlets 22. This flow is caused when the gases exiting the perforated membranes direct the waste water upwards; this movement also reaches the surrounding areas and carries the waste water standing in the interior 18 through the outlets 22.

The outlets 22 therefore ensure a flow of liquid through the interior 18, which effectively prevents the formation of anaerobic sludge.

Figure 3:
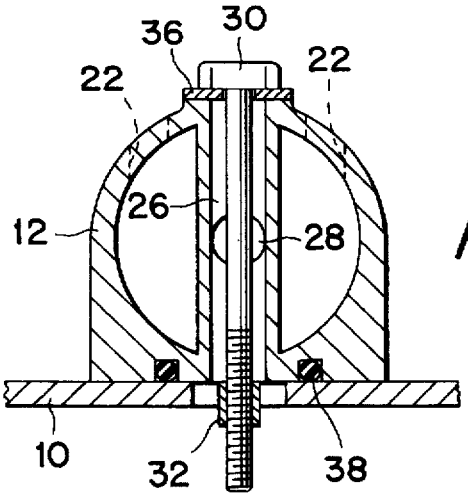
FIG. 3 a cross section through an inlet body along the line of intersection CD.

FIG. 3 shows a cross section of the inlet body 12 along the intersection line CD from FIG. 1.

When mounting the inlet bodies 12 on a gas distributor 10, holes are first bored in the gas distributor and then the inlet bodies 12 with a screw 30 provided with locknuts 32 on their outer end are mounted on the gas distributor 10 at an angle so that the locknuts can penetrate the bored hole 34 at an angle. The screw 30 is raised so that the locknut 32 with its centering collar 44 penetrates the bored hole 34 and wedges there. The screw 30 is then tightened. When an inlet body 12 is exchanged, the locknuts 32 remaining in the bored hole 34 can be reused, as they remain wedged in the bored hole 34 even after the screw 30 is removed.

Figure 4:
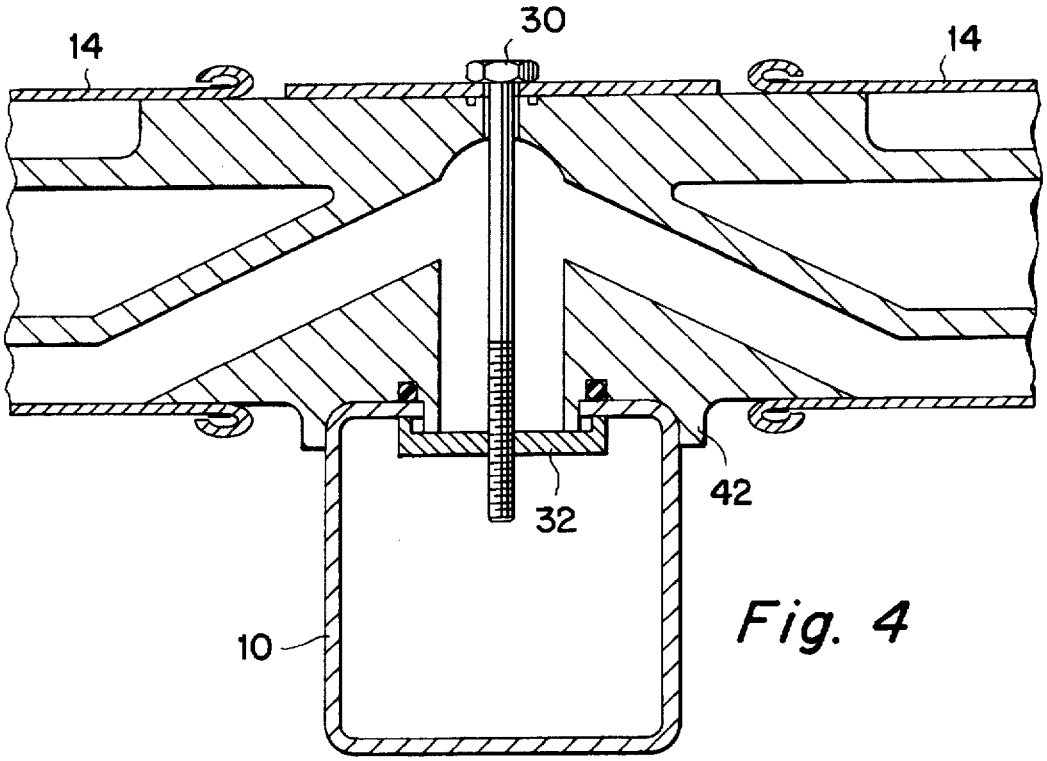
FIG. 4 a longitudinal section similar to that in FIG. 1 with an alternative embodiment of the attachment flange.
Figure 5:
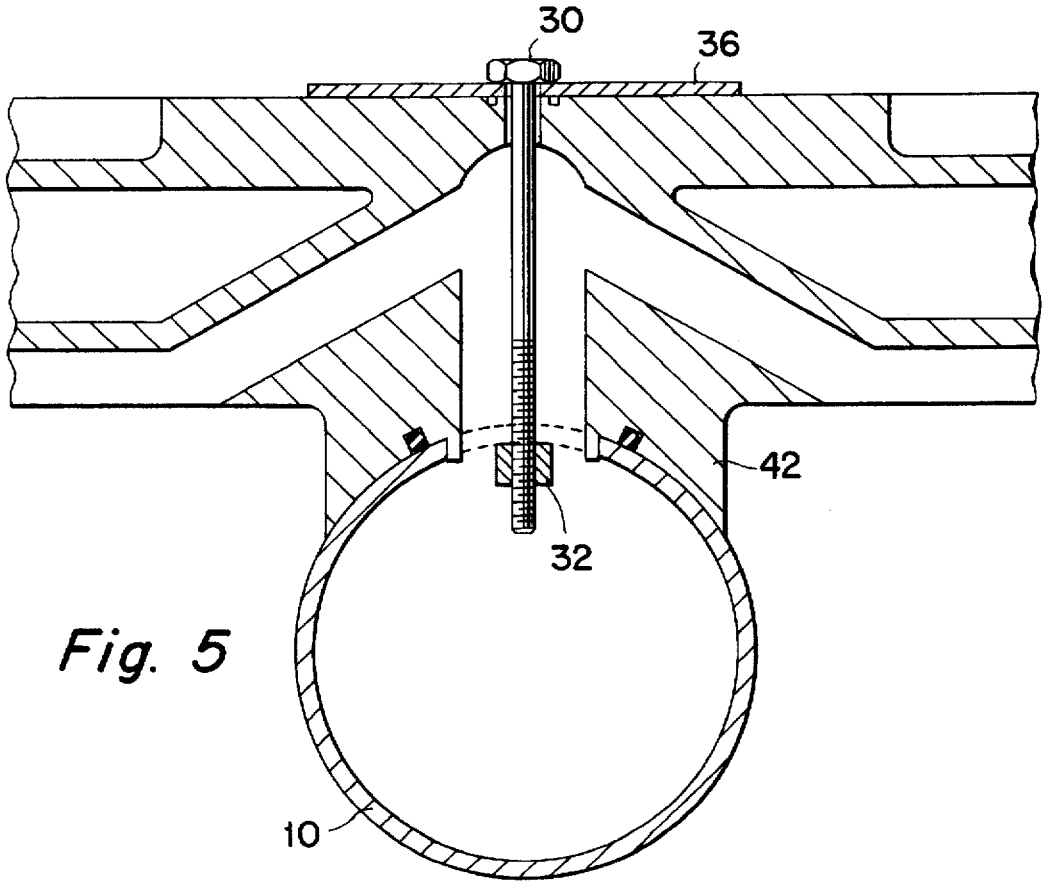
FIG. 5 an additional longitudinal section similar to that in FIG. 1 showing a gas distributor with a circular cross section.

FIG. 4 shows another alternative to the drawing showing a longitudinal section in FIG. 1. In this case, the central body 24 is provided with a centering ring which penetrates the bored hole 34 and performs an additional centering function. The locknuts 32 are provided with L-shaped, angled ends which are in contact with the surface of the gas distributor. In the alternative shown in FIG. 5, the gas distributor 10 is provided with a circular rather than a square cross section.

Figure 6:
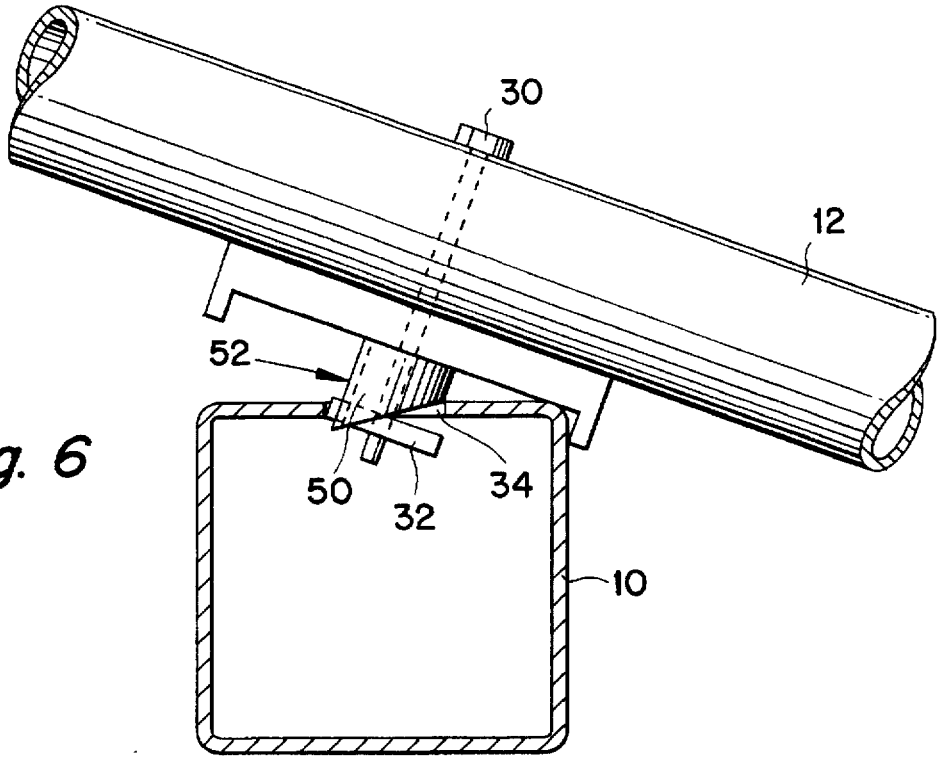
FIG. 6 a view of a gas distributor in cross section on which an inlet body with a projection is mounted.
Figure 7:
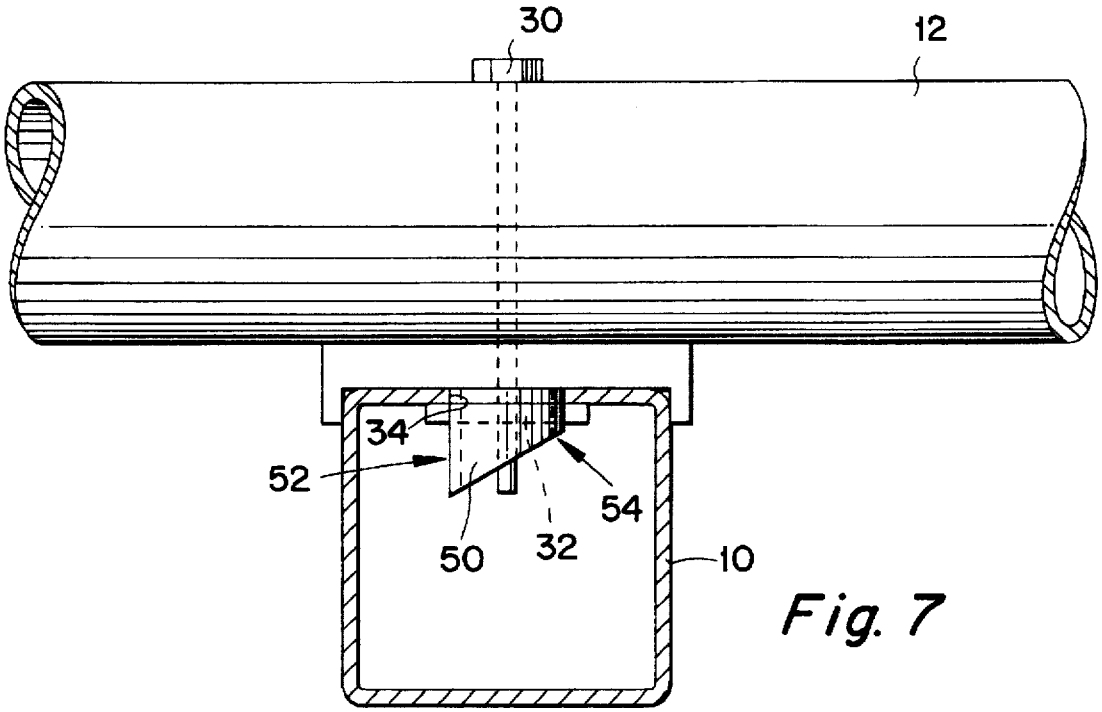
FIG. 7 an inlet body with a projection attached to a gas distributor.

FIG. 6 shows a preferred embodiment of the invention with a gas distributor 10 in cross section on which an inlet body 12 with a projection 50 is mounted, and FIG. 7 shows an inlet body 12 with a projection 50 attached to a gas distributor 10.

The projection 50 is angled to facilitate insertion of the inlet body 12 prepared with screw 30 and locknut 32. The angle of the inlet body 12 in relation to the gas distributor 10 shown in the figure permits the locknut 32 to enter the bored hole 34 when the projection 50 with the locknut 32 is inserted into the bored hole 34 despite a greater diameter, which means that the locknut 32 can then cover the bored hole 34 when the inlet body 12 is aligned with the gas distributor 10. The angle of the projection 50 allows it to enter the bored hole 34 when the inlet body 12 is angled.

I claim:

1. An aeration device which introduces a gas into a liquid, especially waste water which is to be treated, with at least one gas distributor (10), a number of supports (46, 48), each of which is open at their free ends and covered by a perforated, hose-shaped membrane (14), whereby each support (46, 48) is provided with at least one gas outlet which terminates near the membrane (14), whereby the supports (46, 48) project from a central body (24) attached to the gas distributor (10) and to which the gas can flow from the gas distributor (10) through a bored hole (34) and whereby the supports (46, 48) form a single piece as an inlet body (12), characterized in that the gas outlet is a gas feed channel (16) in the shape of longitudinal grooves in each support (46, 48), that the central body (24) is provided with a central channel (26) and two secondary channels (28) extending from it and the latter lead to the gas feed channels (16) in the shape of longitudinal grooves, and that the gas can flow from the gas distributor (10) to the central channel (26) through the bored hole (34).

2. An aeration device as claimed in claim 1, characterized in that the flange on the central body (24) is provided with lateral centering shoulders (42).

3. An aeration device as claimed in claim 1, characterized in that the inlet body (12) is provided with a projection (50) with two axial slits (52, 54), which serves to align the inlet body (12) with the gas distributor (10) and prevent the locknut (32) from twisting by receiving it in the slits (52, 54).

4. An aeration device as claimed in claim 1, characterized in that the thickness of the supports' (46, 48) walls decreases from the central body (24) to theft free ends (20).

5. An aeration device as claimed in claim 4, characterized in that the supports (46, 48) are provided with outlets (22) near the central body (24) which are located in their upper section when ready for operation.

6. An aeration device as claimed in claim 4, characterized in that the inlet body (12) is attached to the gas distributor (10) by means of a screw (30) which penetrates the central channel (26) axially and is provided with a locknut (32) which braces the wall of the gas distributor (10) against the area near the flange of the central body (24), whereby the locknut (32) possesses the shape of a narrow bridge which is narrower and longer than the bored hole (34) in the gas distributor (10).

7. An aeration device as claimed in claim 4, characterized in that a seal, preferably in the shape of a O-ring (38), is located between the gas distributor (10) and the flange of the-central body (24), and that a sealing disk (36) is located between the head of the screw (30) and the surface of the inlet body (12).

8. An aeration device as claimed in claim 4, characterized in that the flange on the central body (24) is provided with lateral centering shoulders (42).

9. An aeration device as claimed in claim 4, characterized in that the inlet body (12) is provided with a projection (50) with two axial slits (52, 54), which serves to align the inlet body (12) with the gas distributor (10) and prevent the locknut (32) from twisting by receiving it in the slits (52, 54).

10. An aeration device as claimed in claim 1, characterized in that the supports (46, 48) are provided with outlets (22) near the central body (24) which are located in their upper section when ready for operation.

11. An aeration device as claimed in claim 10, characterized in that the inlet body (12) is attached to the gas distributor (10) by means of a screw (30) which penetrates the central channel (26) axially and is provided with a locknut (32) which braces the wall of the gas distributor (10) against the area near the flange of the central body (24), whereby the locknut (32) possesses the shape of a narrow bridge which is narrower and longer than the bored hole (34) in the gas distributor (10).

12. An aeration device as claimed in claim 10, characterized in that the flange on the central body (24) is provided with lateral centering shoulders (42).

13. An aeration device as claimed in claim 10, characterized in that a seal is located between the gas distributor (10) and the flange of the central body (24), and that a sealing disk (36) is located between the head of the screw (30) and the surface of the inlet body (12).

14. An aeration device as claimed in claim 13, wherein the seal is in the shape of an O-ring (38).

15. An aeration device as claimed in claim 1, characterized in that the inlet body (12) is attached to the gas distributor (10) by means of a screw (30) which penetrates the central channel (26) axially and is provided with a locknut (32) which braces the wall of the gas distributor (10) against the area near the flange of the central body (24), whereby the locknut (32) possesses the shape of a narrow bridge which is narrower and longer than the bored hole (34) in the gas distributor (10).

16. An aeration device as claimed in claim 15, characterized in that the projection (50) is angled.

17. An aeration device as claimed in claim 15, characterized in that the locknut (32) is provided with a centering collar (44) which penetrates the bored hole (34) of the gas distributor (10).

18. An aeration device as claimed in claim 17, characterized in that the locknut (32) is provided with claws.

19. An aeration device as claimed in claim 17, characterized in that the centering collar (44) possesses a conical shape.

20. An aeration device as claimed in claim 19, characterized in that the locknut (32) is provided with claws.

21. An aeration device as claimed in claim 1, characterized in that a seal is located between the gas distributor (10) and the flange of the central body (24), and that a sealing disk (36) is located between the head of the screw (30) and the surface of the inlet body (12).

22. An aeration device as claimed in claim 21, wherein the seal is in the shape of an O-ring (38).

* * * * *